United States Patent [19]

Wolf et al.

[11] Patent Number: 4,793,491

[45] Date of Patent: Dec. 27, 1988

[54] PRESSURIZABLE CHEMICAL SHIPPING VESSEL

[75] Inventors: Raymond D. Wolf, Chaska; Joshua P. Waldman, Edina, both of Minn.

[73] Assignee: Fluoroware, Inc., Chaska, Minn.

[21] Appl. No.: 934,483

[22] Filed: Nov. 24, 1986

[51] Int. Cl.[4] ..... B65D 21/02; B65D 8/02; B65D 8/06; B65D 90/08

[52] U.S. Cl. ..... 206/509; 220/3; 220/5 R; 220/414; 220/444; 220/465; 220/466

[58] Field of Search ..... 206/509; 220/3, 5 R, 220/410, 414, 444, 465, 466, 469

[56] References Cited

U.S. PATENT DOCUMENTS

| | | | |
|---|---|---|---|
| 2,103,677 | 12/1937 | Kline | 220/466 |
| 2,131,792 | 10/1938 | Coakley | 220/466 |
| 2,503,339 | 4/1950 | Jandus | 220/446 |
| 3,044,607 | 7/1962 | Hopper | 220/5 R |
| 3,093,264 | 6/1963 | Harris | 220/3 |
| 3,098,578 | 7/1963 | Rudelile | 220/465 |
| 3,207,354 | 9/1965 | Skinner | 220/414 |
| 3,210,228 | 10/1965 | Bluck | 220/414 |
| 3,294,271 | 12/1966 | Armbruster | 220/5 R |
| 3,508,677 | 4/1970 | Laibson | 220/3 |

FOREIGN PATENT DOCUMENTS

| | | | |
|---|---|---|---|
| 2351027 | 12/1977 | France | 220/444 |
| 799285 | 8/1958 | United Kingdom | 220/5 R |

*Primary Examiner*—George E. Lowrance
*Attorney, Agent, or Firm*—Faegre & Benson

[57] ABSTRACT

A pressurizable chemical vessel for storing and transporting fluid chemicals and delivering the contents under pressure to the point of the use is comprised of an outer housing, an inner fluid container, and an energy absorbing filler therebetween. The outer housing consists of an upper canister and a canister base removably attached thereto. The entire assembly is desirably of nonmetallic construction and the vessels are designed to be securely stackable for storage and transport. The neck of the chemical vessel is adapted to receive a detachable pressurizable fluid delivery assembly of known design.

10 Claims, 2 Drawing Sheets

PRESSURIZABLE CHEMICAL SHIPPING VESSEL

BACKGROUND OF THE INVENTION

1. Field of the Invention.

This invention relates to an improved pressurizable chemical shipping vessel of composite construction designed for storage, shipping and pressurized dispensing of fluid chemicals. The composite construction of the vessel consists of an external container shell with a removable bottom, a seamless inner fluid container for containing the fluid chemical, and an insulating and shock-absorbing material filling the area between the inner fluid container and the external shell. The chemical shipping vessel may desirably be of entirely nonmetallic construction. The vessel is pressurizable to withstand the necessary pressures for dispensing the fluid chemicals to the point of use. For convenience and easy handling during storage and shipping, the vessel is stackable.

2. Description of the Prior Art.

There are currently available a large variety of containers for fluid chemicals, none of which offer the convenience, safety, and combination of features provided by the present novel chemical vessel.

R. Jurion, et al., U.S. Pat. No. 3,501,055, describes a container for storing and dispensing caustic substances, which utilizes an energy absorbing material to protect and support the inner vessel inside the outer container shell. The container described by Jurion, however, does not possess the specific novel features of the present vessel, which include an outer protective shell with an easily separable bottom to facilitate access to the inner fluid container and interchange of parts which may have been damaged in handling and shipping.

A. Starr, et al., U.S. Pat. No. 3,724,712, describes a container for the bulk shipment of corrosive liquids. The container comprises a rigid outer shell with an inner flexible hollow container, able to conform to the walls of the outer shell by elastic and plastic deformation upon filling. The fluid chemical vessel of the present invention, among other features not found in the Starr container, affords protection from shock and breakage by interposing an energy absorbing filler layer between the inner container and the outer shell.

Boyd, U.S. Pat. No. 4,305,518, shows a portable chemical resistant fiberglass reinforced plastic storage tank, which is constructed with separable side walls and bottom section. Again, the Boyd storage tank does not have the many advantageous novel features of the present shipping vessel, including easy separability of the outer shell and the inner fluid container and an energy absorbing filler layer therebetween to provide additional protection to the container and the fluid contents.

SUMMARY OF THE INVENTION

This invention provides an improved vessel for storing, transporting, and dispensing fluid chemicals and, more specifically, a shock and breakage resistant vessel for storing and transporting fluid chemicals, especially corrosive chemicals, and dispensing them under pressure to their point of use. Other unique aspects of the chemical vessel of the present invention are described by the following features.

The present improved vessel is of a composite construction consisting of a two-part outer shell with a separable bottom, an inner chemically inert fluid container which can be removed when the outer shell is disassembled, and an energy absorbent material filling the space between the inner liner and the outer shell. The composite construction allows for easy replacement of individual parts which may become damaged in handling or shipping, thus providing for longer life and increased cost efficiency for the vessel.

The inner fluid container is of seamless construction, designed to assure complete drainability in an inverted position. Since the present vessel is designed for repeated use as a returnable service container, ease of maintenance for periodic thorough cleaning is essential.

The present novel vessel is of pressurizable design to facilitate transfer of the fluid chemical from the container through tubing to the point of use. In most normal pressurized dispensing procedures from a pressurizable container, pressures of 20–30 psi are generally employed. The present vessel is designed to withstand pressures of 45 psi. In dispensing the fluid chemical contents to their point of use, the improved vessel of this invention may be used with a detachable pressurizable fluid delivery insert assembly of any standard design and construction adapted for use with a pressurizable fluid container. The particular fluid delivery assembly insert forms no part of the present invention. However, the present novel chemical vessel is advantageously adapted for use with the bung drum insert assembly as described in the co-pending commonly owned application Ser. No. 815,025, filed Dec. 30, 1985, by Robert W. Grant, et al., entitled BUNG CONNECTION, which is a continuation-in-part of application Ser. No. 713,869, filed Mar. 20, 1985, which description is specifically incorporated herein by reference.

Further, in order to facilitate efficient handling, transport and storage, the vessels according to the present invention are designed to be easily and securely stackable, with the foot ring of one vessel nesting with the top stacking crown of another identical vessel.

These and other features of the novel fluid chemical vessel of this invention will be apparent to those skilled in this art upon reading the following detailed description in reference to the accompanying drawings.

DETAILED DESCRIPTION OF THE INVENTION

Figure 1:
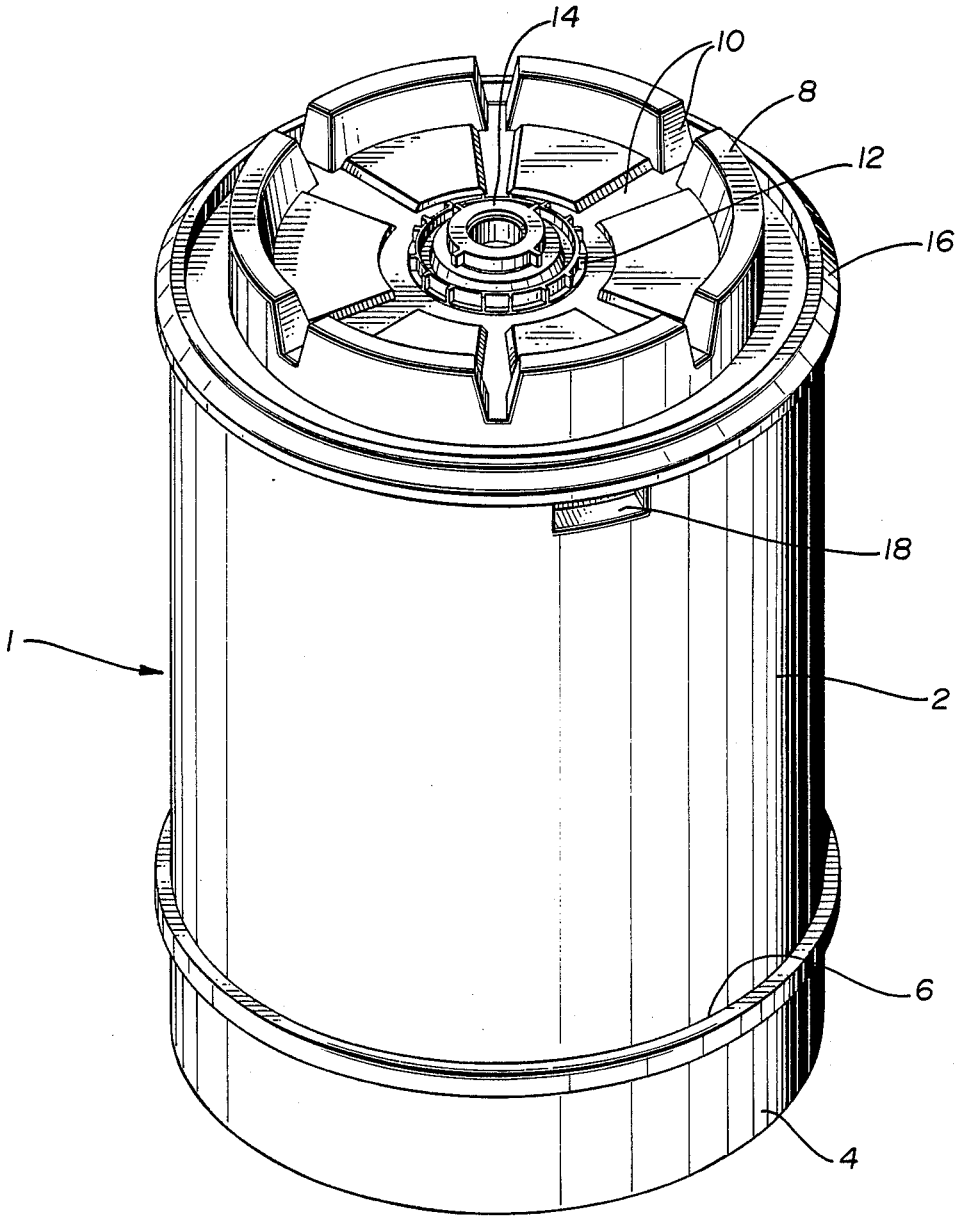
FIG. 1 is a pictorial view of the complete vessel assembly secured with shipping/storage plug.
Figures 2, 3:
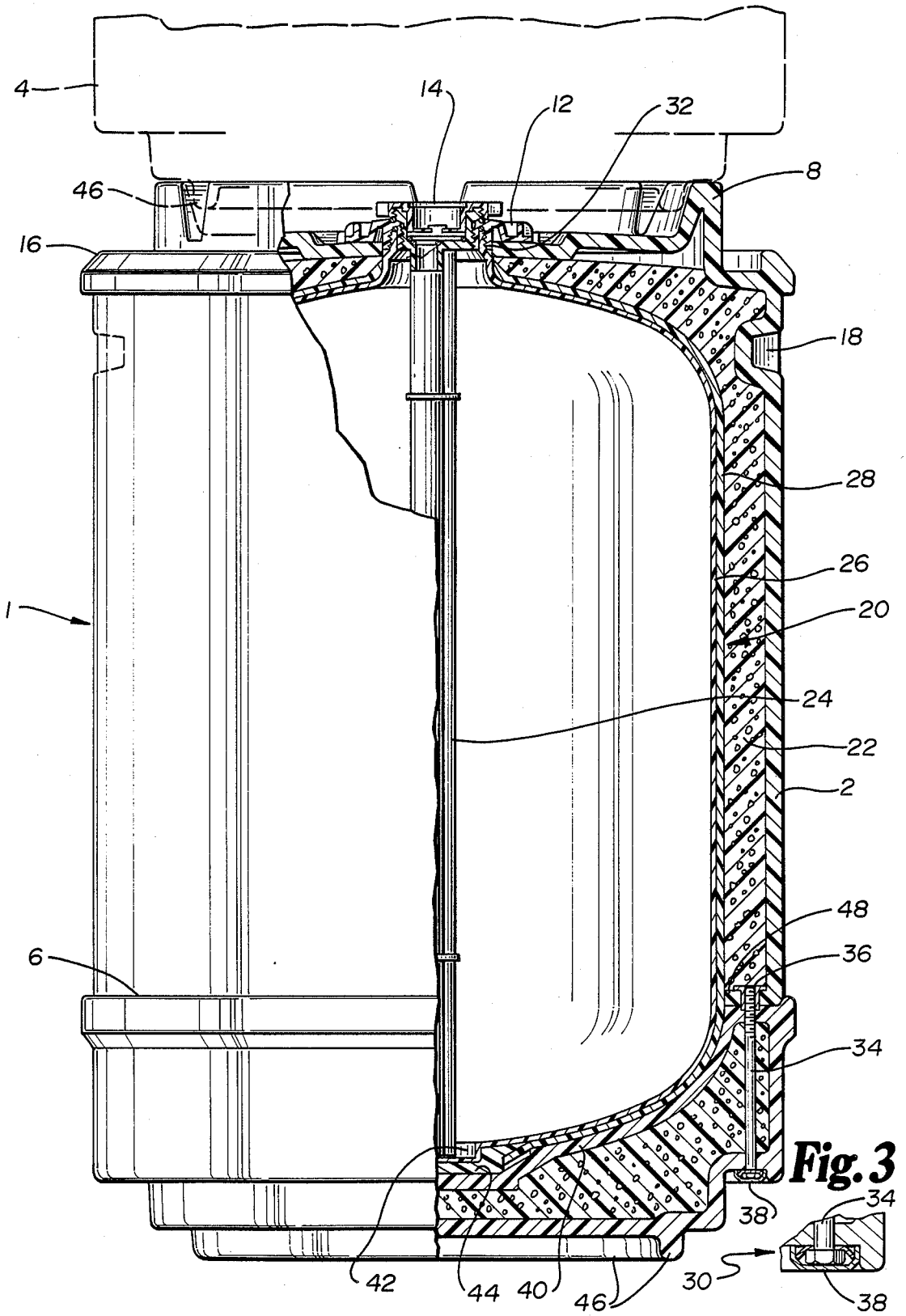
FIG. 2 is a side elevational view of the complete vessel assembly with parts cut away and with an additional stacked vessel assembly shown in dashed line.
FIG. 3 is a detail view of the fastener for securing the canister housing, shown slightly enlarged.

In FIG. 1, the complete vessel assembly 1 according to this invention comprises a generally rigid outer housing, consisting of an upper canister 2 and a separate canister base 4, with the canister base 4 removably secured to the upper canister 2 by means of a plurality of bolt fastener assemblies 30, shown in FIG. 3. The canister base 4 overlaps the upper canister 2 by a slight lip, with the point of separation of the canister base 4 from the upper canister 2 demarcated by the separation line 6. The complete vessel assembly may desirably be of cylindrical shape to provide better resistance to the pressurization necessary during fluid delivery.

The top surface of the upper canister 2 is provided with a plurality of upstanding flanges integral with the top surface, which upstanding flanges together form a circular stacking crown 8 concentric with and at a spaced distance from the outer perimeter rim 16 of the upper canister 2. The top surface of the upper canister 2 is further provided with an embossed area inside each of the plurality of flanges, so as to form with the flanges of the stacking crown 8, air passage reliefs 10 which are important for the stackability feature of the present novel vessel. In stacking, the foot ring 46 of the canister base 4 will fit just inside the ring formed by the upstanding flanges of the circular stacking crown 8, as shown in FIG. 2. The top surface of the upper canister 2 is formed with a gentle taper of, for example, about 3 degrees, away from the center bung nut 12. Thus, the area on the top surface of the upper canister 2 defined between the outer perimeter rim 16 and the circular stacking crown 8 forms a recessed concentric well to confine any minor amount of spillage from the bung connection preventing drippage down the sides of the vessel assembly 1. A plurality of indented hand holds 18 may desirably be provided on the wall of the upper canister 2 underneath the rim 16. The outer housing is desirably formed of a high impact and corrosion resistant synthetic material such as, for example, a high density polyethylene.

The center of the top surface of the upper canister 2 is designed to accommodate the bottle nut 12 of the bung adaptor sleeve of a detachable fluid delivery insert assembly for delivering under suitable pressure the fluid contents of the vessel to the desired point of use. The fluid delivery insert assembly 1 may be of any standard design and construction adapted for use with a pressurizable fluid container. in FIG. 1, the complete vessel assembly 1 is shown with the shipping/storage plug 14 of the fluid delivery insert assembly in place. The complete vessel assembly 1 may be of any desirable size, with a vessel having a capacity of 100 liters of fluid being advantageous for general commercial use.

In FIG. 2, the vessel assembly 1 is shown with parts cut away to illustrate the separable outer housing, the inner fluid container 20, the energy absorbing filler material 22 and other details of construction. The necked inner fluid container 20 is disposed in spaced relationship to the inner surfaces of the generally rigid outer housing, with a slight concave well 42 on the middle of the bottom of the inner surface of the fluid container 20 to accommodate the tubular ducting 24 of the fluid delivery insert assembly. An advantageous feature of the bottom concave well 42 allows for a maximum of 99.5% by volume of the fluid chemical contents to be delivered from the present novel vessel under normal pressurized delivery. With pressurized fluid delivery from conventional vessels not possessing this advantageous bottom well construction, it is usual for 4–5% by volume of residual fluid contents to remain in the bottom as wastage.

The outer housing of the vessel assembly 1 consists of the upper canister 2 and the canister base 4 secured thereto by means of a plurality of fastener assemblies 30. Each fastener assembly 30 comprises a stainless steel bolt which fits snugly through an aperture in the canister base 4 and a corresponding aperture in the concentric inward directed flange 48 at the bottom of the side wall of the upper canister 2 and is secured in place with a blind nut 36 on the interior of the flange 48 and a hex head cap 38 on the bottom surface of the canister base 4. The necked inner fluid container 20 may desirably be formed of a liner 26 with an exterior layup 28, so that the entire vessel assembly 1 may withstand pressures for fluid delivery of up to about 45 psi. Thus, desirably, the liner 26 may be of tetrafluoroethylene synthetic resin and the layup 28 may be of fiberglass. The space between the inner fluid container 20 and the upper canister 2 is filled with an energy absorbing material 22 such as, for example, vermiculite, fiberglass batting, polystyrene foam, polyurethane foam, and the like. It is preferred that the filler material be performed to conform to the area defined betwen the inner fluid container 20 and the upper canister 2 in order to avoid any settling or shifting of the filler contents during handling and shipping. Desirably, the filler material may be formed of polyurethane foam. The inner fluid container 20 is formed of seamless construction throughout to provide easy and complete drainability in an inverted position, and to prevent undesirable retention of any of the fluid contents during cleaning procedures. The canister base 4 is formed of a double wall construction, with the inner surface of the canister base 4 generally conforming to the shape of the bottom of the inner fluid container 20 as a support diaphragm 40. The middle of the inner surface of the canister base 4 has a liner socket cup 44 to accommodate the well 42 on the bottom of the inner fluid container 20. The interior of the double wall construction of the canister base 4 is filled with filler material of the same composition and preformed construction as that used for the filler 22 in the space between the inner fluid container 20 and the upper canister 2. In addition to the support provided by the support diaphragm 40, the inner fluid container 20 is supported by contact with the concentric inward directed flange 48 at the bottom of the side wall of the upper canister 2 and by contact with the neck opening in the middle of the top surface of the upper canister 2. The bottom of the canister base 4 terminates in a protruding concentric foot ring 46, which is sized and positioned to nest just inside the circular stacking crown 8 on the top surface of the upper canister 2, as shown in FIG. 2.

The neck of the inner fluid container 20 has threads 32 formed on the upper outer surface thereof. A bottle nut 12 with interior threading is designed to engage the threads 32 on the upper outer surface of the inner fluid container 20 and is also attached to the tubular ducting 24 of the fluid delivery insert assembly. The fluid delivery insert assembly, as has been previously mentioned, may be of any standard design and construction adapted for use with a pressurizable fluid container and the fluid delivery insert assembly itself forms no portion of the present invention. As shown in FIGS. 1 and 2, when secured for storage or transport, the complete vessel assembly of this invention is provided with a shipping/storage plug 14, which is screw fit with the bottle nut 12.

What is claimed is:

1. A pressurizable vessel for storing, transporting, and dispensing fluid chemicals having an inner container and an outer container, wherein the improvement comprises:

an inner container having a filler neck extending from the upper surface thereof through a correspondingly sized neck opening in the upper surface of the outer container;

the outer container being fitted around the inner container in spaced relationship therefrom;

the outer container consisting of an upper member and a base member separably attached to each other by cooperating securing means;

the upper member contacting and supporting the inner container at the neck opening in the top surface of the upper member and at a concentric inward flange at the bottom of the side wall of the upper member;

the base member being of double wall construction with the inner surface of the base member being shaped to contact and support the inner container by generally conforming to the bottom outer surface of the inner container;

the space defined by the double wall construction of the base member of the outer container and the space defined between the inner container and the upper member of the outer container being filled with an inert energy absorbing material to provide mechanical support for said inner container and to block the transmission of shock thereto; and the base member and the upper member of the outer container and the inner container all being separable from each other upon detachment of the base member from the upper member.

2. A pressurizable vessel according to claim 1, wherein the inner container is of seamless construction with a slight concave well on the middle of the bottom of the inner surface and is comprised of an inner liner with an exterior layup.

3. A pressurizable vessel according to claim 2, wherein the inner container is comprised of an inner liner of tetrafluoroethylene synthetic resin with an exterior layup of fiberglass.

4. A pressurizable vessel according to claim 1, wherein the outer container is of high density polyethylene.

5. A pressurizable vessel according to claim 1, wherein:

the top surface of the upper member of the outer container is provided with a plurality of upstanding flanges integral with the top surface, which upstanding flanges together form a circular stacking crown concentric with and at a spaced distance from the outer perimeter rim of the top surface such that a recessed concentric area on the top surface is defined between the stacking crown and the outer perimeter rim; and the bottom of the base member of the outer container terminates in a protruding concentric foot ring which is sized and positioned such that the foot ring of the base member of a first pressurizable vessel nests in stacking arrangement just inside the circular stacking crown on the top surface of the upper member of a second pressurizable vessel.

6. A pressurizable vessel according to claim 5, wherein a plurality of indented hand holds are provided on the wall of the upper member of the outer container underneath the perimeter rim thereof.

7. A pressurizable vessel according to claim 1, wherein the inert energy absorbing material is selected from vermiculite, fiberglass batting, polystyrene foam, and polyurethane foam.

8. A pressurizable vessel according to claim 7, wherein the inert energy absorbing material is preformed of polyurethane foam.

9. A pressurizable vessel according to claim 1, wherein the filler neck of the inner container is adapted to accept a detachable pressurizable fluid delivery insert assembly.

10. A pressurizable vessel according to claim 1, with a capacity of 100 liters and able to withstand pressures of 45 psi.

* * * * *